US008500490B2

(12) United States Patent
Tsou

(10) Patent No.: US 8,500,490 B2
(45) Date of Patent: Aug. 6, 2013

(54) CONNECTOR SHIELDING APPARATUS AND METHODS

(75) Inventor: Cheng Jung Tsou, Yang Mei Chen (TW)

(73) Assignee: Pulse Electronics, Inc., San Diego, CA (US)

( * ) Notice: Subject to any disclaimer, the term of this patent is extended or adjusted under 35 U.S.C. 154(b) by 0 days.

(21) Appl. No.: 13/476,786

(22) Filed: May 21, 2012

(65) Prior Publication Data

US 2012/0231662 A1 Sep. 13, 2012

Related U.S. Application Data

(63) Continuation of application No. 12/632,542, filed on Dec. 7, 2009, now Pat. No. 8,182,291.

(60) Provisional application No. 61/201,460, filed on Dec. 11, 2008.

(51) Int. Cl.
*H01R 9/03* (2006.01)

(52) U.S. Cl.
USPC ..... 439/607.55; 439/927; 439/939

(58) Field of Classification Search
USPC ..... 439/607.55, 607.01, 607.37, 607.38, 439/607.35, 607.23, 607.2, 541.5, 927, 607.11, 439/607.3, 939, 607.28
See application file for complete search history.

(56) References Cited

U.S. PATENT DOCUMENTS 6,095,862 A * 8/2000 Doye et al. ..... 439/607.11
6,276,963 B1 8/2001 Avery et al.
6,368,153 B1 4/2002 Hwang
6,434,015 B1 8/2002 Hwang
6,478,622 B1 * 11/2002 Hwang ..... 439/607.2
6,517,382 B2 2/2003 Flickinger et al.
6,655,995 B1 12/2003 Reisinger et al.
6,805,573 B2 10/2004 Phillips et al.
7,070,446 B2 7/2006 Henry et al.
7,288,001 B1 10/2007 Aekins
7,309,250 B2 12/2007 Reed et al.
7,322,845 B2 1/2008 Regnier et al.
7,351,104 B2 4/2008 Neer et al.
7,438,596 B2 10/2008 Phillips
7,455,554 B2 * 11/2008 Long ..... 439/607.17
7,583,510 B2 * 9/2009 Wang ..... 361/753
7,727,018 B2 * 6/2010 Bright et al. ..... 439/607.28
2002/0025720 A1 2/2002 Bright et al.
2002/0146926 A1 10/2002 Fogg et al.
2002/0197043 A1 12/2002 Hwang
2003/0077950 A1 4/2003 Swearingenm et al.
2005/0037655 A1 2/2005 Henry et al.
2006/0068639 A1 3/2006 Barringer et al.
2006/0198639 A1 9/2006 Giaretta et al.
2006/0279937 A1 * 12/2006 Manson et al. ..... 361/724
2008/0070439 A1 3/2008 Kusuda et al.
2008/0171469 A1 * 7/2008 Phillips ..... 439/607
2008/0299826 A1 12/2008 Cheng

* cited by examiner

*Primary Examiner* — Javaid Nasri
(74) *Attorney, Agent, or Firm* — Gazdzinski & Associates, PC

(57) ABSTRACT

An electrical connector assembly having shielded cage assembly with at least one port for receiving modules, and methods of manufacture and use thereof. In one embodiment, the modules comprise SFP-type (small form-factor pluggable) modules, and the shielded cage assembly comprises an EMI shield member that is disposed at a port opening for the electrical connector assembly. In one variant, the EMI shield member can be disposed on the electrical connector cage assembly without the need for secondary processing techniques such as soldering, or resistance welding. This is accomplished via for example the utilization of mechanical snap features.

19 Claims, 19 Drawing Sheets

102
104
104
104
4

106
102
100

CONNECTOR SHIELDING APPARATUS AND METHODS

PRIORITY AND RELATED APPLICATIONS

This is a continuation of, and claims priority to, U.S. patent application Ser. No. 12/632,542 filed Dec. 7, 2009, now U.S. Pat. No. 8,182,291, of the same title, which claims priority to U.S. Provisional Patent Application Ser. No. 61/201,460 filed Dec. 11, 2008 entitled "Connector Shielding Apparatus And Methods", each of the foregoing incorporated herein by reference in its entirety. This application is also generally related to the subject matter of co-pending U.S. patent application Ser. No. 12/011,796 filed Jan. 29, 2008 and entitled "Low-Profile Connector Assembly and Methods" which claims priority to U.S. Provisional Patent Application Ser. No. 60/898,677 filed Jan. 30, 2007 of the same title, and to U.S. Provisional Patent Application Ser. No. 61/010,318 filed Jan. 4, 2008 and entitled "Heterogeneous Connector Apparatus and Methods of Manufacture (SFP over RJ)", each of the foregoing incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The present invention relates generally to electrical or electronic connector systems and in one exemplary aspect, to low-profile connector systems for pluggable electronic modules, such as transceiver modules for high-speed fiber optic and copper communications, and methods for manufacturing the same.

DESCRIPTION OF RELATED TECHNOLOGY

Small form-factor pluggable ("SFP") optical transceiver modules that combine transmitter and receiver functions in a compact package format are well known in the prior art. Such SFP modules are used to support, inter alia, Fibre Channel and Gigabit Ethernet (GBE) applications with data rates between 1 Gbps and 4 Gbps. The SFP standard is also further expanding to what is known as "SFP+" which will be able to support data rates up to 10 Gbit/s (that will include the data rates for 8 gigabit Fibre Channel and 10 GbE).

SFP connector assemblies into which the SFP modules are pluggable are also well known. Examples of these pluggable-type connector assemblies can be found in disclosures such as U.S. Pat. No. 6,276,963 to Avery (hereinafter "Avery '963"), et al. issued Aug. 21, 2001 and entitled "Adapter frame assembly for electrical connectors", incorporated herein by reference in its entirety. The Avery '963 patent discloses an adapter frame assembly for receiving at least a pair of connectors in a stacked array with one connector above another connector at a different spacing there between. The assembly includes a pair of frame structures including a top frame structure and a bottom frame structure, each including a receptacle for receiving a respective one of the stacked connectors. The top frame structure may be mounted directly on top of the bottom frame structure and, thereby, place the receptacles and the respective connectors at a first spacing. A spacer is selectively mountable between the frame structures to space the receptacles and the respective connectors at a second, increased spacing.

Other pluggable connectors and/or receptacles are evidenced in the prior art. For example, see U.S. Pat. No. 6,368,153 to Hwang issued Apr. 9, 2002 and entitled "Small form-factor pluggable transceiver cage"; U.S. Pat. No. 6,434,015 to Hwang issued Aug. 13, 2002 and entitled "Small form-factor pluggable module having release device"; U.S. Pat. No. 6,517,382 to Flickinger, et al. issued Feb. 11, 2003 and entitled "Pluggable module and receptacle"; U.S. Pat. No. 6,655,995 to Reisinger, et al. issued Dec. 2, 2003 and entitled "Electrical connector receptacle cage with interlocking upper and lower shells"; U.S. Pat. No. 6,805,573 to Phillips, et al issued Oct. 19, 2004 and entitled "Connector module with lever actuated release mechanism"; U.S. Pat. No. 7,070,446 to Henry, et al. issued Jul. 4, 2006 and entitled "Stacked SFP connector and cage assembly"; U.S. Pat. No. 7,309,250 to Reed, et al. issued Dec. 18, 2007 and entitled "Plug connector ejector mechanism with integrated return action"; U.S. Pat. No. 7,322,845 to Regnier, et al. issued Jan. 29, 2008 and entitled "Connector de-latching mechanism with return action"; U.S. Pat. No. 7,351,104 to Neer, et al. issued Apr. 1, 2008 and entitled "Keyed housing for use with small size plug connectors"; United States Patent Publication No. 20020025720 to Bright, et al. published on Feb. 28, 2002 and entitled "Stacked transceiver receptacle assembly"; United States Patent Publication No. 20020146926 to Fogg, et al. published on Oct. 10, 2002 and entitled "Connector interface and retention system for high-density connector"; United States Patent Publication No. 20020197043 to Hwang, published on Dec. 26, 2002 and entitled "Stacked GBIC guide rail assembly"; United States Patent Pub. No. 20050037655 to Henry, et al. published Feb. 17, 2005 and entitled "Stacked Sfp Connector And Cage Assembly"; United States Patent Pub. No. 20060198639 to Giaretta; et al. published Sep. 7, 2006 and entitled "High speed SFP transceiver"; United States Patent Pub. No. 20060279937 to Manson; et al. published Dec. 14, 2006 and entitled "Gasket retainer"; United States Patent Pub. No. 20080070439 to Kusuda; et al. published Mar. 20, 2008 and entitled "Connector mounting structure"; and United States Patent Pub. No. 20080171469 to Phillips; published Jul. 17, 2008 and entitled "Electrical connector assembly with EMI gasket".

Although conventional pluggable designs have been used successfully in the past, they have tended to be unsuitable for ever-increasing data rates in combination with the cost demands of the telecommunications industry. As SFP optical transceiver module technology has progressed (e.g., towards SFP+ data rates), it has become increasingly desirable to improve the electromagnetic interference (EMI) performance of the connector by providing additional grounding for the cage shield. Due to FCC regulations, there is a need not only to minimize the EMI emissions of the module, but also to contain the EMI emissions of the host system in which the module is mounted regardless of whether or not a module is plugged in to the receptacle. However, telecommunications standards such as SFP+ are highly restrictive with regards to the mechanical design of the shield.

Accordingly, there is a need for a connection system design that can be made to conform to existing standards (such as e.g., the SFP and SFP+ standard), while simultaneously minimizing EMI emissions and simplifying the manufacturability of the connection system design (thereby minimizing costs). In addition, it is desirable that the connection system design be backwards-compatible in order to economize on costs such as tooling costs and manufacturing space.

SUMMARY OF THE INVENTION

The present invention fulfills the foregoing needs by providing, inter alia, novel features that improve the EMI performance of the connector assembly while minimizing costs.

In a first aspect of the invention, an electrical connector is disclosed. In one embodiment, the electrical connector comprises a shield member assembly comprising a port opening. The shield member assembly comprises an EMI shield member disposed at the periphery of the port opening. The EMI shield member comprises a snap feature that interacts with a respective feature at the port opening. The snap feature obviates the need for secondary processing techniques when disposing the EMI shield member at the periphery of the port opening.

In a second aspect of the invention, a method of manufacturing an electrical connector is disclosed. In one embodiment, the method comprises forming a shield member assembly and an EMI shield member and disposing the EMI shield member on the shield member assembly without the need for secondary processing techniques.

In a third aspect of the invention, a method of using an electrical connector mountable on a printed circuit board in a telecommunications apparatus is disclosed. The method comprises providing a shield member assembly comprising a plurality of features adapted to mate with an EMI shield member with the plurality of features adapted to permit the attachment of the EMI shield member on the shield member assembly without the need for secondary processing techniques. The method comprises a first connector configuration without the EMI shield member disposed on the shield member assembly. In one variant, the method further comprises disposing the EMI shield member onto the shield member assembly thereby forming a second connector configuration.

In a fourth aspect of the invention, a shield member assembly is disclosed. In one embodiment, the shield member assembly comprises an EMI shield member wherein the EMI shield member can be disposed onto a top shield member without the need for secondary processing techniques.

In a fifth aspect of the invention, an EMI shield member is disclosed. In one embodiment, the EMI shield member can be installed onto a connector cage assembly without the need to use secondary processing techniques.

In a sixth aspect of the invention, a method of assembling an electrical connector assembly is disclosed. In one embodiment, the method comprises obtaining an electrical connector assembly that includes an insulative housing that is comprised of at least one module receiving slot along with a shield assembly having a port opening that at least partly encloses the insulative housing and subsequently attaching a noise shield member to the periphery of the port opening via the use of a snap feature that cooperates with a respective feature at the port opening. The snap feature on the noise shield member obviates the need for one or more secondary processing techniques when disposing the noise shield member at the periphery of the port opening.

In a seventh aspect of the invention, a method of doing business is disclosed. In one embodiment, the method comprises providing a connector cage assembly comprising a first configuration and further comprising a plurality of assembly features for adapting the connector cage assembly to a second configuration; inserting an EMI shield member into the plurality of assembly features thereby assembling the second configuration for the connector cage assembly wherein costs are reduced by virtue of the connector cage assembly comprising first and second configurations.

BRIEF DESCRIPTION OF THE DRAWINGS

The features, objectives, and advantages of the invention will become more apparent from the detailed description set forth below when taken in conjunction with the drawings, wherein.

Figure 1:
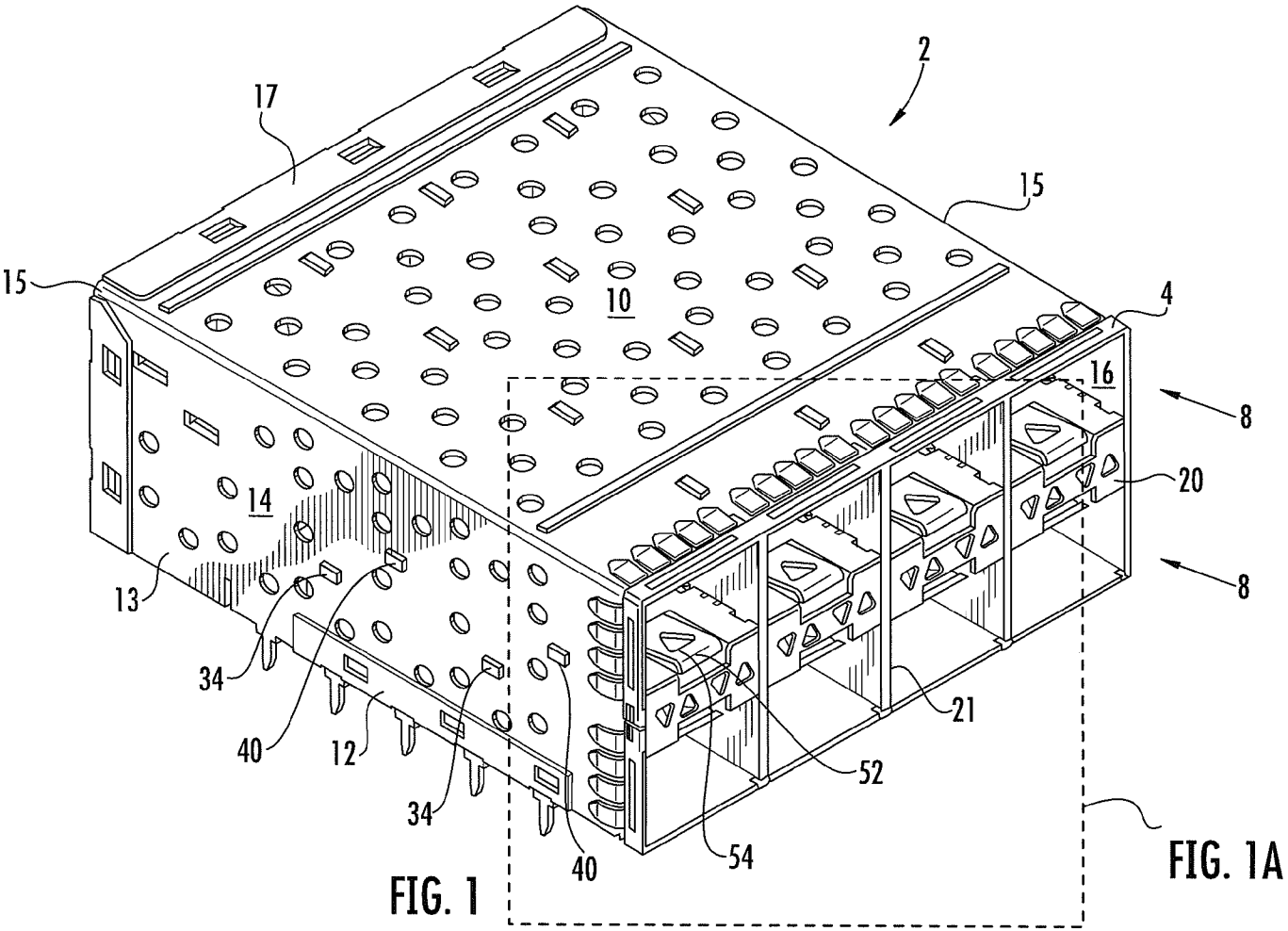
FIG. 1 is a perspective view of one embodiment of an electrical connector cage assembly manufactured in accordance with the principles of the present invention.

All Figures disclosed herein are © Copyright 2008-2009 Pulse Engineering, Inc. All rights reserved.

DETAILED DESCRIPTION OF THE PREFERRED EMBODIMENT

Reference is now made to the drawings wherein like numerals refer to like parts throughout.

As used herein, the term "integrated circuit (IC)" refers to without limitation any type of device, whether single or multiple die, having any level of integration (including without limitation ULSI, VLSI, and LSI) and irrespective of process or base materials (including, without limitation Si, SiGe, CMOS and GaAs). ICs may include, for example, memory devices (e.g., DRAM, SRAM, DDRAM, EEPROM/Flash, ROM), digital processors, SoC devices, FPGAs, ASICs, ADCs, DACs, transceivers, memory controllers, and other devices, as well as any combinations thereof.

As used herein, the term "memory" includes any type of integrated circuit or other storage device adapted for storing digital data including, without limitation, ROM. PROM, EEPROM, DRAM, SDRAM, DDR/2 SDRAM, EDO/FPMS, RLDRAM, SRAM, "flash" memory (e.g., NAND/NOR), and PSRAM.

As used herein, the term "digital processor" is meant generally to include all types of digital processing devices including, without limitation, digital signal processors (DSPs), reduced instmction set computers (RISC), general-purpose (CISC) processors, microprocessors, gate arrays (e.g., FPGAs), PLDs, reconfigurable compute fabrics (RCFs), array processors, secure microprocessors, and application-specific integrated circuits (ASICs). Such digital processors may be contained on a single unitary IC die, or distributed across multiple components.

As used herein, the term "signal conditioning" or "conditioning" shall be understood to include, but not be limited to, signal voltage transformation, filtering and noise mitigation, signal splitting, impedance control and correction, current limiting, capacitance control, and time delay.

As used herein, the terms "electrical component" and "electronic component" are used interchangeably and refer to components adapted to provide some electrical and/or signal conditioning function, including without limitation inductive reactors ("choke coils"), transformers, filters, transistors, gapped core toroids, inductors (coupled or otherwise), capacitors, resistors, operational amplifiers, and diodes, whether discrete components or integrated circuits, whether alone or in combination.

It is noted that the terms "top", "bottom", "upper", "lower" and "back" as used herein are not specific to any relative or absolute orientation; i.e., the "top" surface of a device when mounted upside-down, may actually comprise the "bottom" surface. Accordingly, these terms are only used for purposes of illustration and convenience, and are no way limiting on the various embodiments of the invention.

It is also noted that while the following description is cast primarily in terms of a single or stacked SFP type connector assembly and associated SFP modules (including "SFP+"), the present invention may be used in conjunction with any number of different connector types. For example, the principles discussed in this disclosure may be applied to other connector types and/or standards with proper adaptation including, without limitation, the Registered Jack (RJ); Small Form Factor (SFP); Quad Small Form factor Pluggable transceiver (QSFP); and the 10 Gigabit Small Form Factor Pluggable (XFP) standards. Accordingly, the following discussion of the SFP type connectors and modules is merely illustrative of the broader concepts of the invention.

The present invention may also be combined with other types of technologies and capabilities such as e.g., using one or more integrated circuits within or in conjunction with the connector assembly.

Overview

The present invention discloses, inter alia, a noise (e.g., EMI) shield that minimizes EMI emissions, reduces device susceptibility to external radiators and eases device manufacture. The EMI shield includes in one embodiment attachment features as well as EMI tabs in order to accomplish these tasks. In an exemplary configuration, the EMI shield is used in a connector assembly that receives pluggable modules such as the exemplary small form factor pluggable (SFP) transceivers discussed previously herein.

In one such implementation, the EMI shield utilizes both vertical snap features as well as horizontal snap features in order to secure the EMI shield to the underlying connector assembly. These snap features include a generally C-shaped element that fits around an edge of the connector assembly. In addition, a louvered feature which is to be received within a respective slot of the connector assembly helps further secure the EMI shield to the connector assembly. The EMI shield design possesses several advantages over prior art techniques in that the design obviates the need for secondary processing techniques such as eutectic solder operations, spot welding and the like, although these methods can be utilized as well if desired.

Furthermore, the snap design of the EMI shield member is relatively simple in construction and can be produced with simplified tooling (resulting in cheaper tooling costs), as well as reducing the material consumed during the manufacturing process. In addition, the snap design of the EMI shield can be pushed onto the connector assembly without requiring any sort of manipulation of the EMI shield member or top shield member by the user. In other words, the EMI shield member can be attached to the connector assembly via a single user action (i.e. by inserting the EMI shield member onto the front face of the connector). Because of this, installation of the EMI shield member is simplified, and can readily be automated if desired. Also, the snap design is readily reversible in certain implementations such that the remaining cage member assembly is compatible with prior art connector designs such as an SFP (as opposed to SFP+) connector design.

Mechanical Embodiments

Figure 1A:
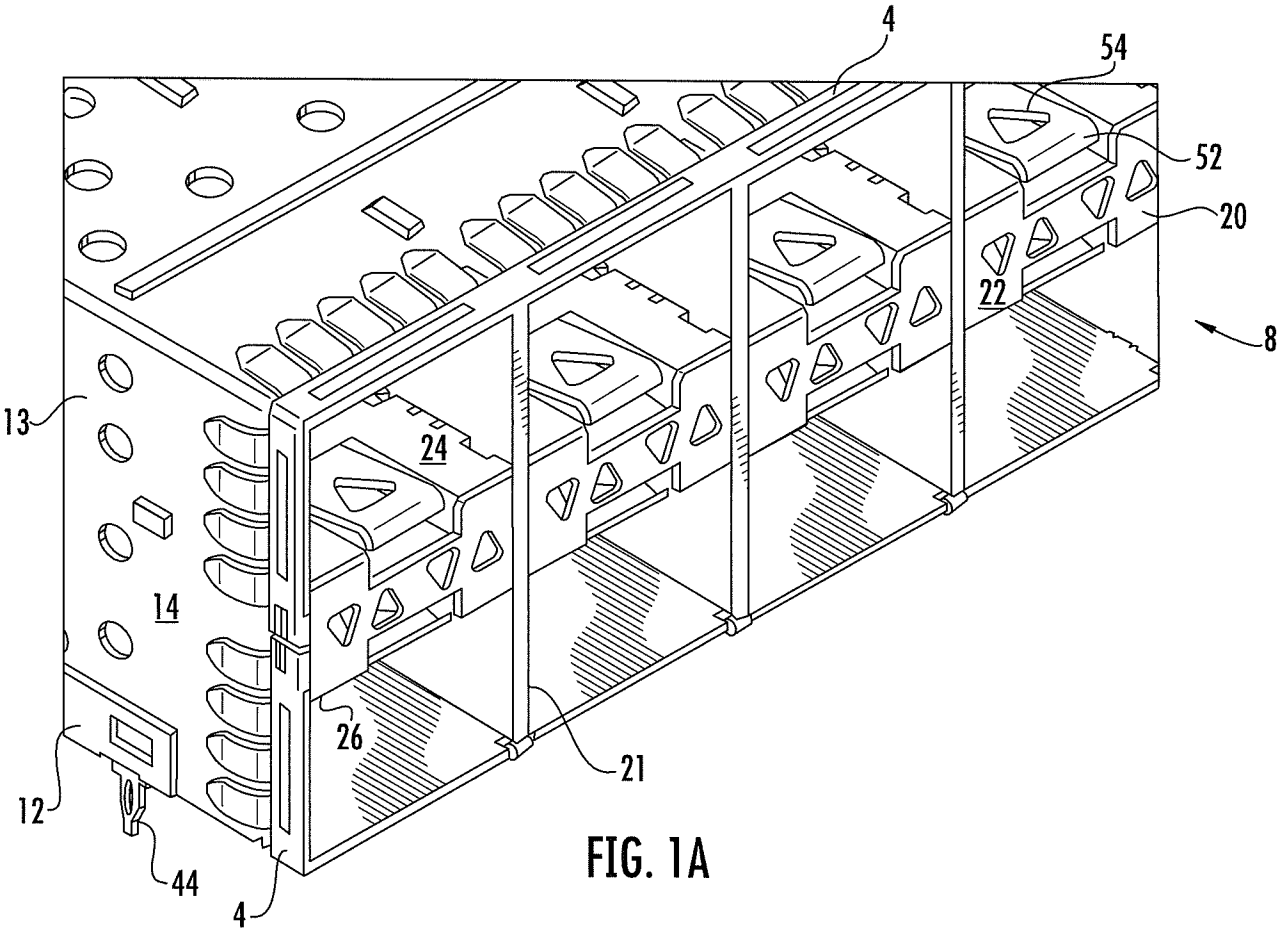
FIG. 1A is a detailed perspective view of the port openings of the electrical connector cage assembly of FIG. 1.
Figure 1B:
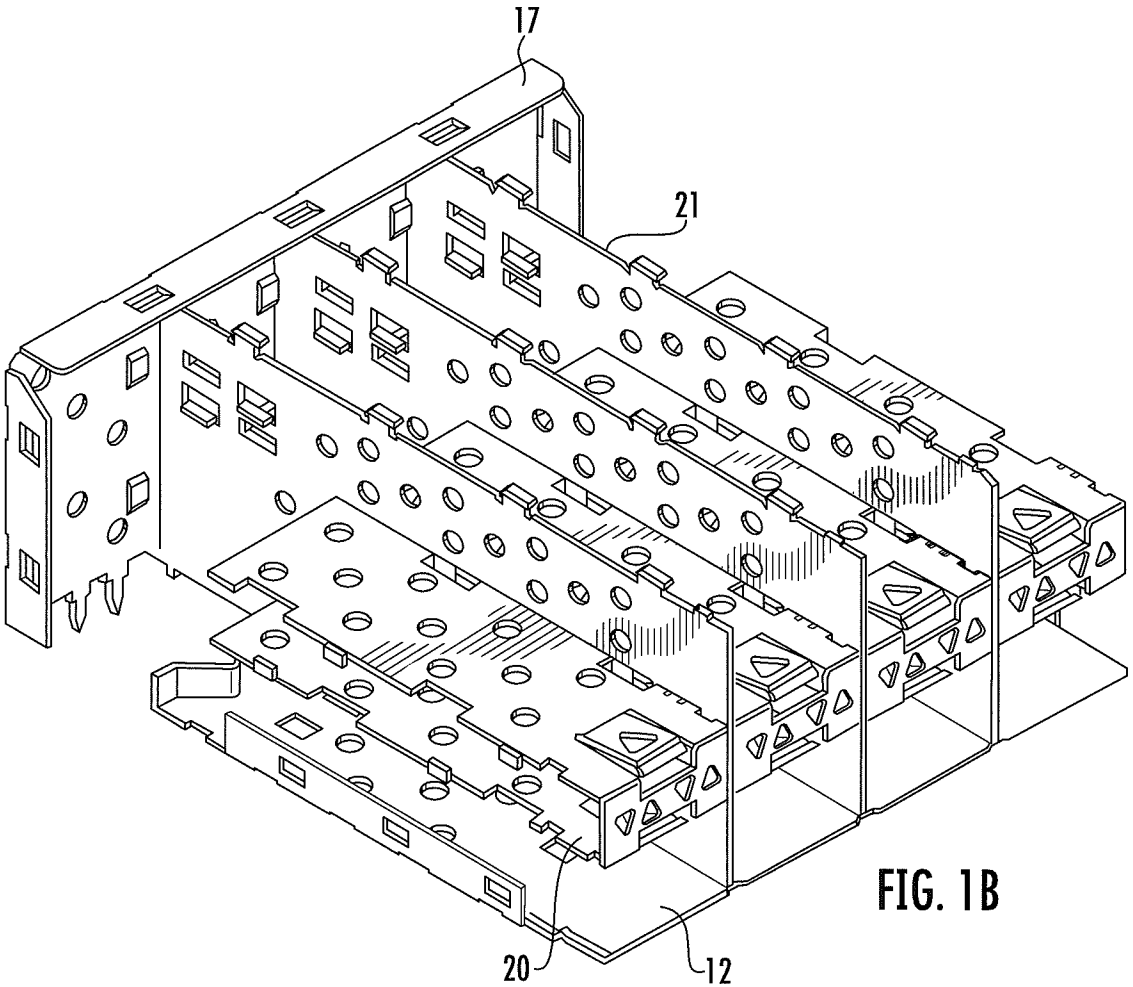
FIG. 1B is a perspective view of the electrical connector cage assembly of FIG. 1 with the top cage member removed.
Figure 1C:
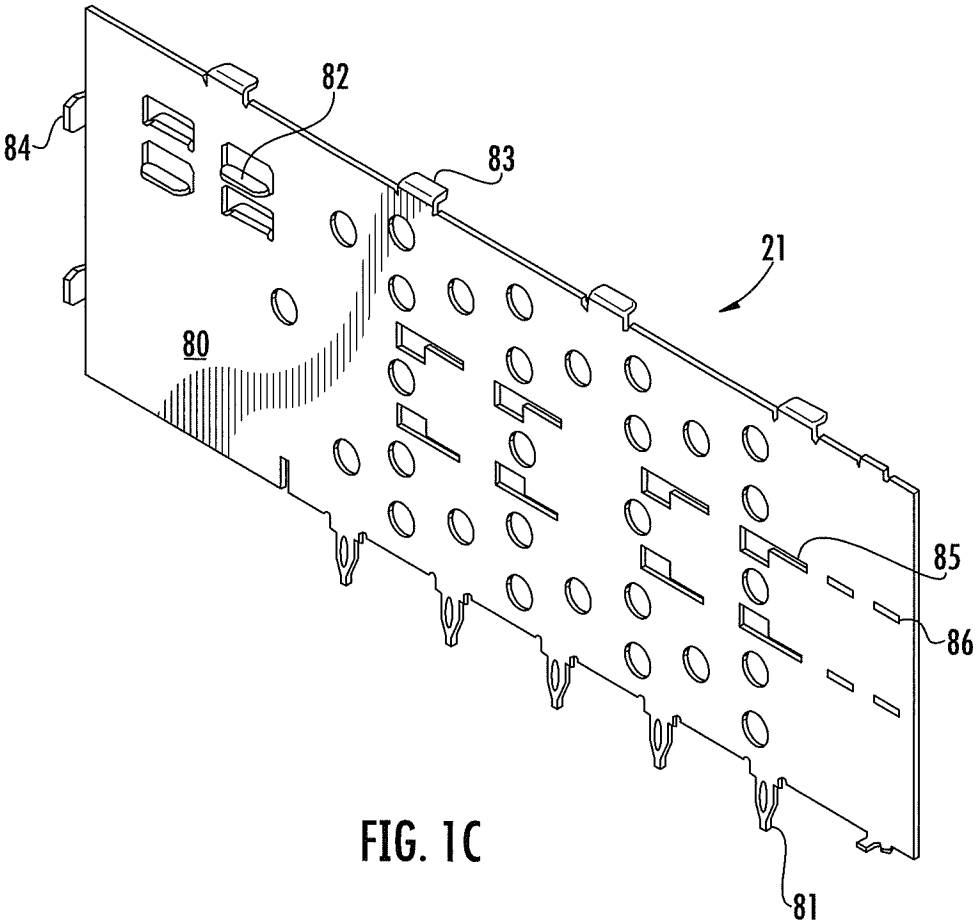
FIG. 1C is a perspective view of the divider cage member of the electrical connector cage assembly of FIG. 1.
Figure 1D:
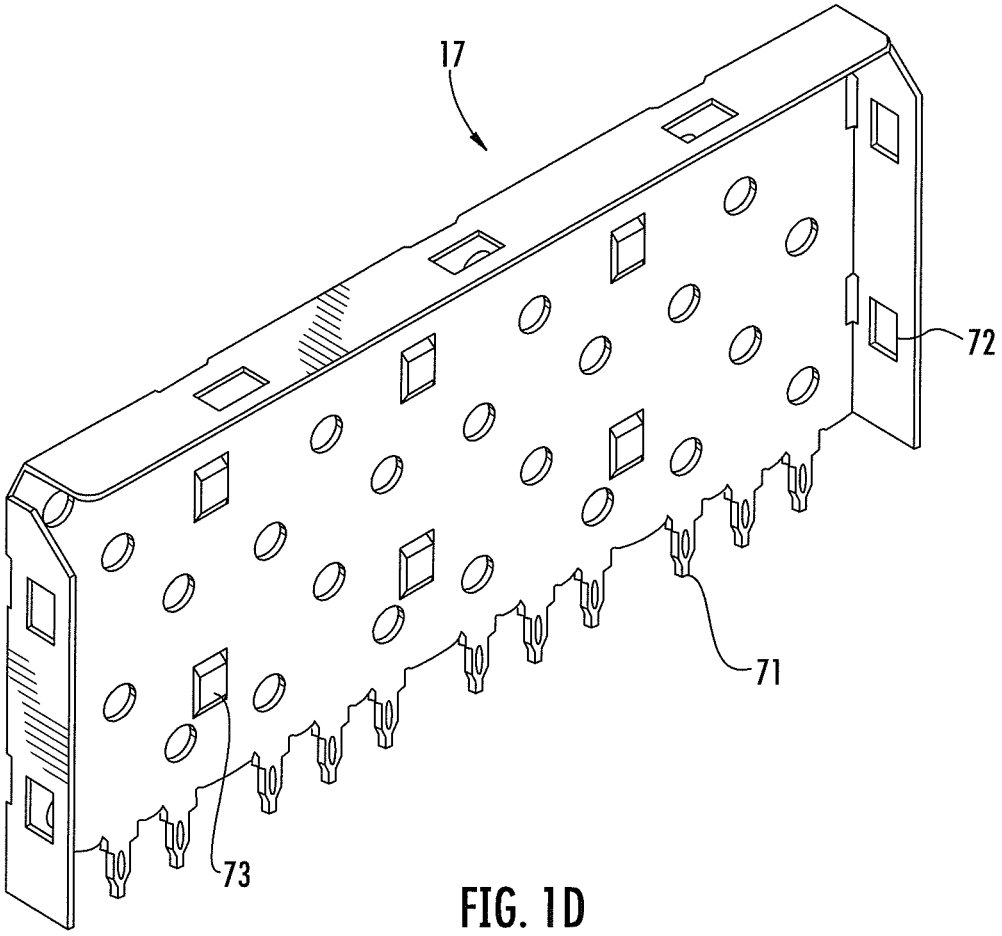
FIG. 1D is a perspective view of the back cage member of the electrical connector cage assembly of FIG. 1.
Figure 1E:
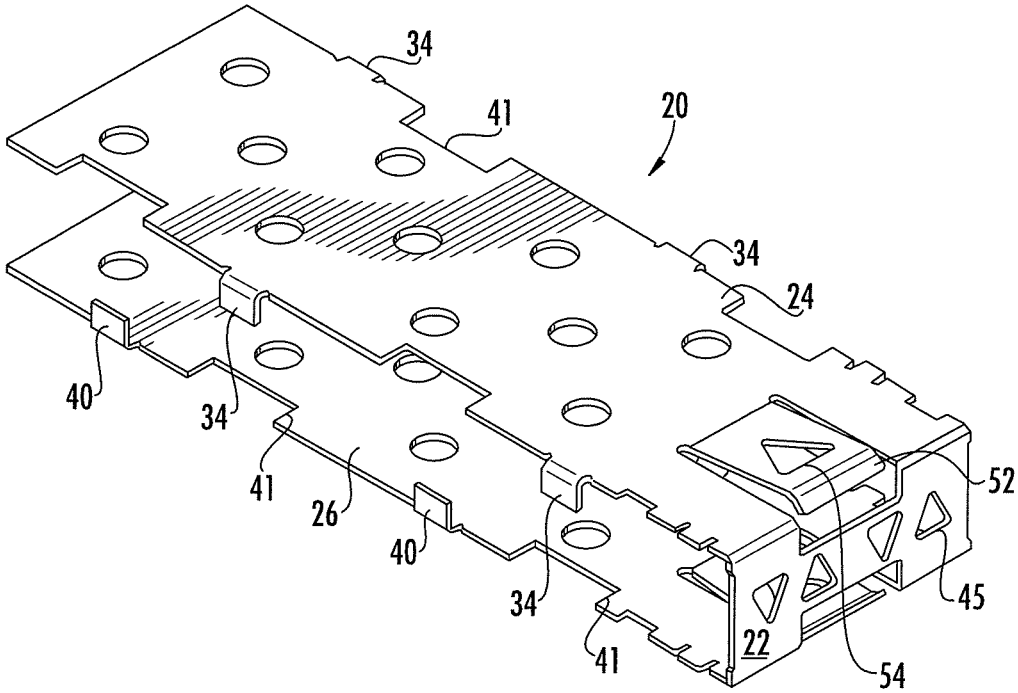
FIG. 1E is a perspective view of the separator cage member of the electrical connector cage assembly of FIG. 1.
Figure 1F:
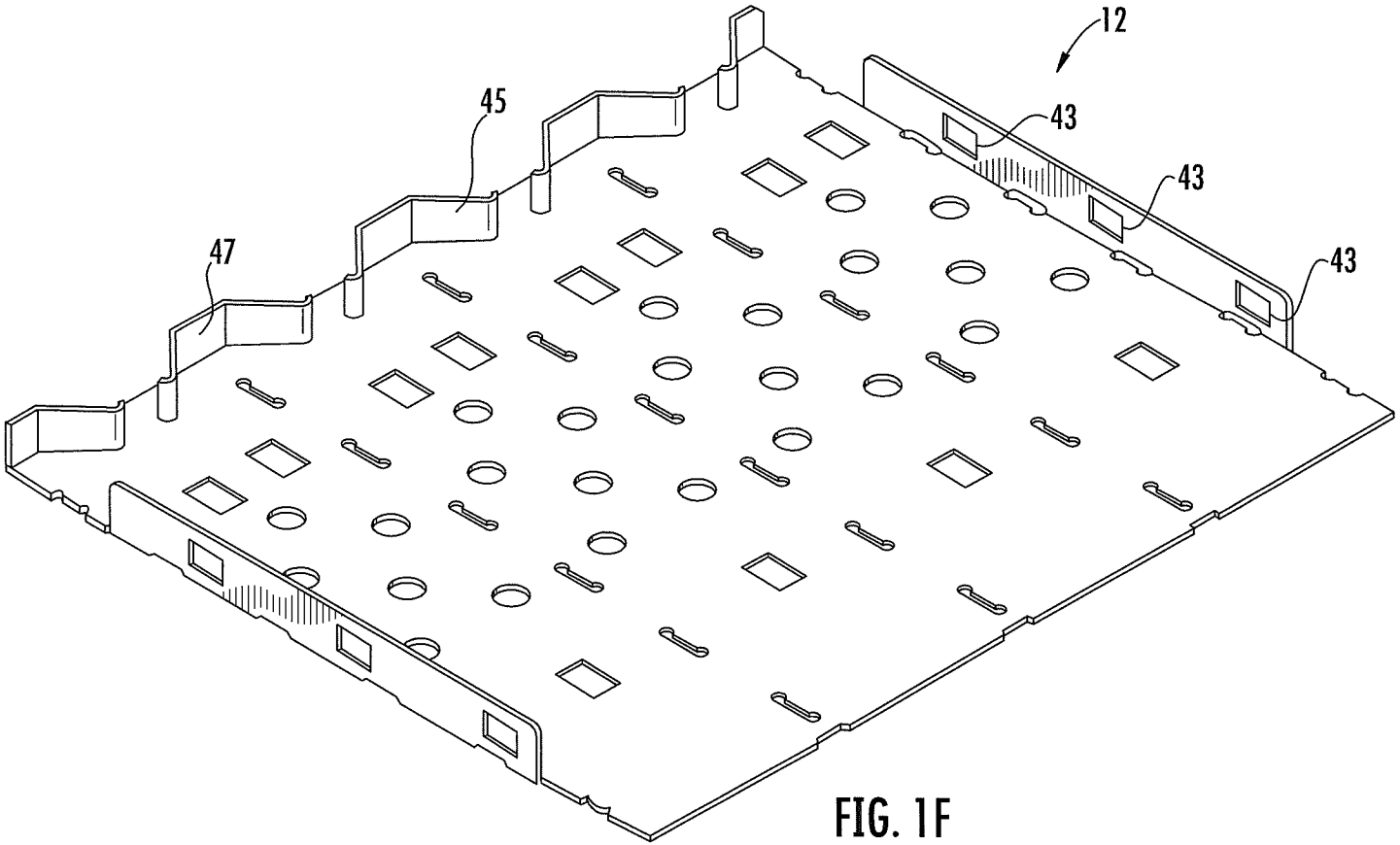
FIG. 1F is a perspective view of the bottom cage member of the electrical connector cage assembly of FIG. 1.
Figure 1G:
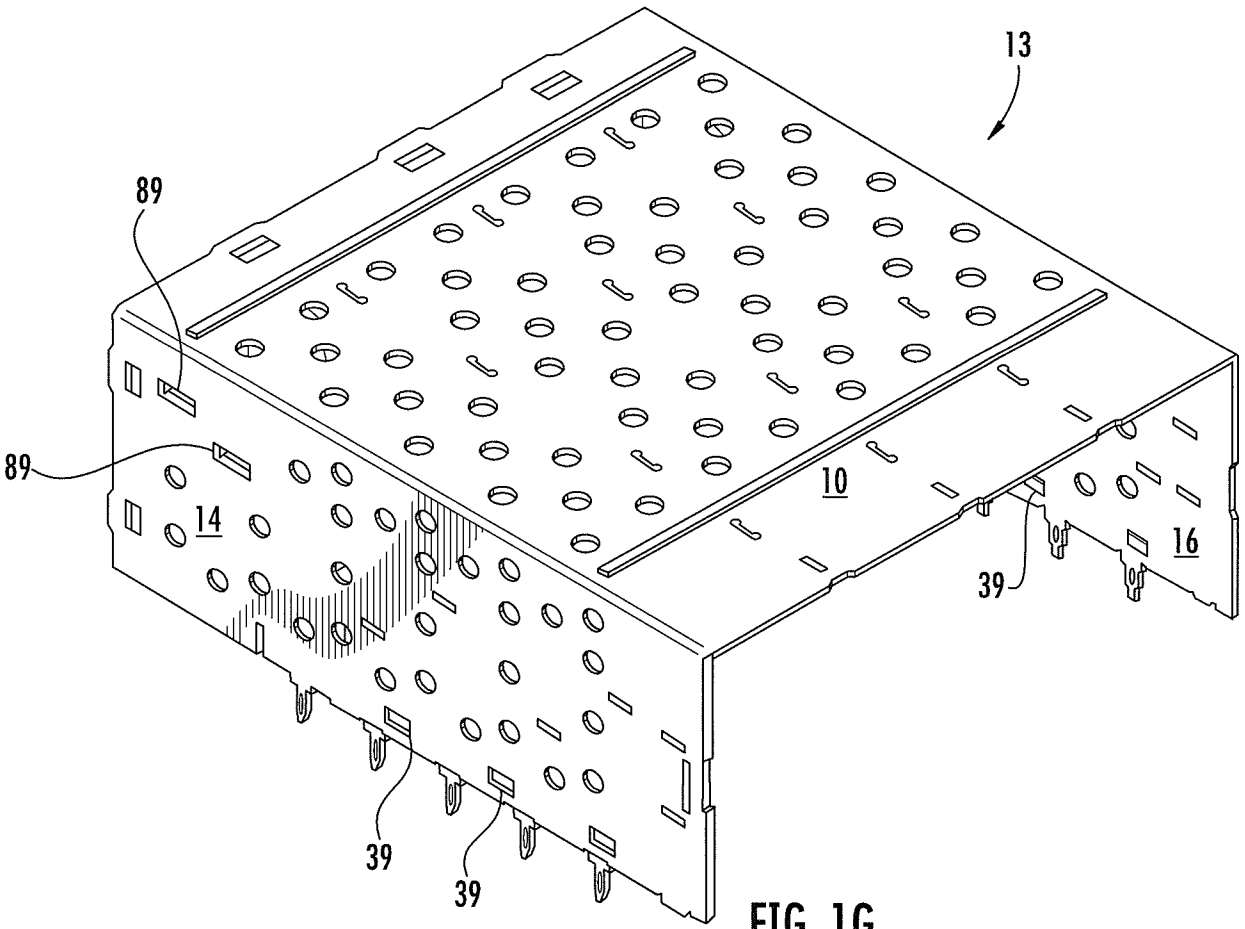
FIG. 1G is a perspective view of the top cage member of the electrical connector cage assembly of FIG. 1.

With reference to FIGS. 1-1G, a first embodiment of an electrical connector cage assembly 2 manufactured in accordance with the principles of the present invention is shown generally. The cage assembly 2 comprises a stamped and formed metallic structure (e.g., a copper based alloy or the like) with various integrated features that enhance the manufacture of the assembly, although it will be appreciated that other materials and configurations may be used consistent with the invention. It should be recognized from FIG. 1 that the connector assembly 2 is intended for placement on an external device or substrate (e.g., motherboard or PCB) and includes a plurality of ports 8 for receipt of pluggable modules (not shown), although other placements and configurations may be employed.

The illustrated cage assembly 2 includes a bottom shielded member 12 and a top cage member 13 defined generally by side walls 14, 16 and top wall 10, with the side walls 14, 16 adjoined to the top wall 10 via sheet metal bends 15. The cage assembly 2 also includes a separator member 20 secured to the side walls 14, 16 via a plurality of top 40 and bottom bent tabs 34. As perhaps can best be viewed in FIG. 1A, the separator member 20 defines the internal boundaries separating the upper and lower rows of the plurality of ports 8. The cage assembly 2 further comprises divider members 21 which separate adjacent columns of ports 8.

The illustrated cage assembly further comprises a bottom cage member 12 that defines the underside of the cage assembly and a back cage member 17 that defines the back wall of the assembly 2.

The cage member assembly has numerous features that facilitate the grounding of the cage assembly to a motherboard and/or a panel. As perhaps is shown best in FIG. 1A, the end perimeter of the cage assembly includes a plurality of substrate (e.g., printed circuit board) tines 44, which are configured to both mechanically hold the cage assembly to a motherboard or other substrate, as well as to ground the cage assembly thereto. Around the perimeter of the cage assembly towards the front edge thereof (i.e. the end of the cage assembly where the eight (8) ports 8 of the cage assembly are located), the cage member assembly 2 includes a plurality of EMI cage members 4, which are profiled to engage an edge of an opening in an electrical panel or other structure through which the cage assembly can be inserted. This EMI cage member 4 is discussed subsequently herein with respect to FIGS. 2-2C.

The top wall 24 and bottom wall 26 of separator member 20 further comprise grounding tabs 52 adjacent a front edge thereof for grounding the internally mounted module (not shown for purposes of clarity) that is to be inserted therein.

As previously discussed, the illustrated cage member assembly 4 is subdivided into rows by way of a center separator member 20, having a front face portion at 22 with an upper wall 24 and a lower wall 26. The center separator member 20 is retained in place by the tabs 34 and 40, which extend from side edges of the upper and lower walls 24, 26, and which extend through the side walls 14, 16 of the top cage member 13, as best shown in FIGS. 1 and 1E. However, other methods including surface mounted soldering techniques, locator features (i.e., bumps and the like) may be substituted with essentially equal effectiveness. The grounding tabs 52 of the separator member also latch openings 54, which aid in module removal.

Referring now to FIG. 1B, the cage assembly 2 of FIG. 1 is illustrated with the top cage member removed. From this perspective, the relationship between various ones of the cage members is more readily apparent. Specifically, the relationship between the divider cage members 21, back cage member 17, bottom cage member 12 and separator cage members 20 are readily visible.

Referring now to FIG. 1C, various features of the exemplary divider cage member 21 are illustrated. The divider cage member generally comprises a planar stamped base material 80 further including various features that allow it to be attached to other ones of shield members present in the assembly. For example, back tabs 84 are utilized to mechanically and electrically connect the divider member 21 to the back cage member 17. Top tabs 83 perform the same functionality as the back tabs, and interact with respective features located on the top shield member 13. Various slot features 85, 86 are stamped into the base material of the divider cage member 21 so as to electrically/mechanically secure the separator member 20 with respect to the divider cage member. In addition, connector guide features interact with the connector housing (not shown) to mechanically support the connector housing within the cage assembly. Such connector housings utilized for SFP and SFP+ applications are well known to those of ordinary skill, and are described in, for example, co-owned and co-pending U.S. patent application Ser. No. 12/011,796 filed Jan. 29, 2008 and entitled "Low-Profile Connector Assembly and Methods" which claims priority to U.S. Provisional Patent Application Ser. No. 60/898,677 filed Jan. 30, 2007 of the same title, previously incorporated herein by reference in its entirety.

Circuit board tines 81 are also stamped into the divider cage member 21 so as to electrically/mechanically secure the divider cage member to an external printed circuit board or other structure.

Referring now to FIG. 1D, one embodiment of the back cage member 17 is now shown and described in detail. The back cage member, in an exemplary embodiment, comprises a stamped and folded sheet of a metallic base material comprising a plurality of features 72 for securing the back cage member to the top cage member 13. In addition, the back cage member comprises a plurality of circuit board tines 71. Alignment features 73 facilitate the alignment of the divider cage members 21 (FIG. 1C) as well as provide a surface so that the back cage member 17 can be mechanically (and optionally electrically) attached via the use of epoxies, solder and the like.

Referring now to FIG. 1E, one embodiment of the separator member 20 of connector assembly 2 is shown and described in detail. The separator member 20 comprises top 24 and bottom walls 26 and a front wall 22. The walls 24 and 26 include grounding tabs 52 adjacent a front edge thereof for grounding the internally-mounted module to be inserted therein, as well as the latch opening 54 which facilitates module removal.

As previously discussed with reference to FIG. 1, the separator member 20 comprises a plurality of upper tabs 34 and lower tabs 40 that are adapted to connect the separator member 20 to the top cage member 13 and/or the divider cage member 21 (FIG. 1C). These tabs 34, 40 may optionally be secured (via a eutectic solder, conductive epoxy and the like) to enhance the electrical performance of the cage assembly 2. A plurality of slots 41 are also located on the top and bottom walls 24, 26 of the separator member 20. These slots 41 are preserved for 2×N SFP embodiments when two (2) of the separator members are adjacent to one another, and are adapted to accommodate the tabs 34, 40 from adjacent separator members 20 in 2×N embodiments. In the configuration illustrated, the front face 22 of the separator member 20 also includes a plurality of indicator ports 45, which permit viewing of light pipes or other types of indicators (e.g., LEDs, liquid crystals, etc.) that may be included within the connector.

Referring now to FIG. 1F, one embodiment of the bottom shield member 12 of the cage assembly 2 is shown and described in detail. The bottom shield member 12 comprises a plurality of latching features 43 which are adapted to interface with respective louver features 39 located on the top shield member 13 (see FIG. 1G). On the back wall 47 of bottom section 12 resides a plurality of EMI tabs 45. These EMI tabs 45 serve two (2) main purposes. The first purpose is to interact with the plugged transceiver module, and provide grounding to the module to improve the EMI performance of the assembly (such as the assembly 2 shown in FIG. 1). A second purpose of the EMI tabs 45 is to facilitate the ejection of the pluggable modules after insertion. Specifically, the EMI tabs 45 in the illustrated embodiment act as springs that facilitate extraction of the pluggable modules when desired (i.e., bias the module(s) in the direction of removal).

Referring now to FIG. 1G, one embodiment of the top cage member 13 is shown and described in detail. The top cage member 13 comprises two side walls 14, 16 and a top wall 10. The top cage member 13 is preferably formed from a single sheet of a metallic base material that is subsequently stamped and formed. The side walls 14, 16 possess a plurality of features that facilitate the assembly of the top cage member 13 with other components to form the connector assembly 2 of FIG. 1. For instance, alignment features 89 are utilized to align the top cage member 13 with the connector.

A plurality of louver features 39 are formed (e.g., stamped) into the bottom periphery of top cage member 13; these features are adapted to mate with respective features 43 on the bottom cage member 12 (FIG. 1F), thereby permitting quick assembly of the bottom cage member 12 with the top cage member 13. Additional operations (e.g. soldering, welding/brazing, conductive epoxy, and the like) can be added at the interface between the louver features 39 and their mating features 43 so as to enhance electrical and mechanical connectivity between the two components.

Figures 2, 2A:
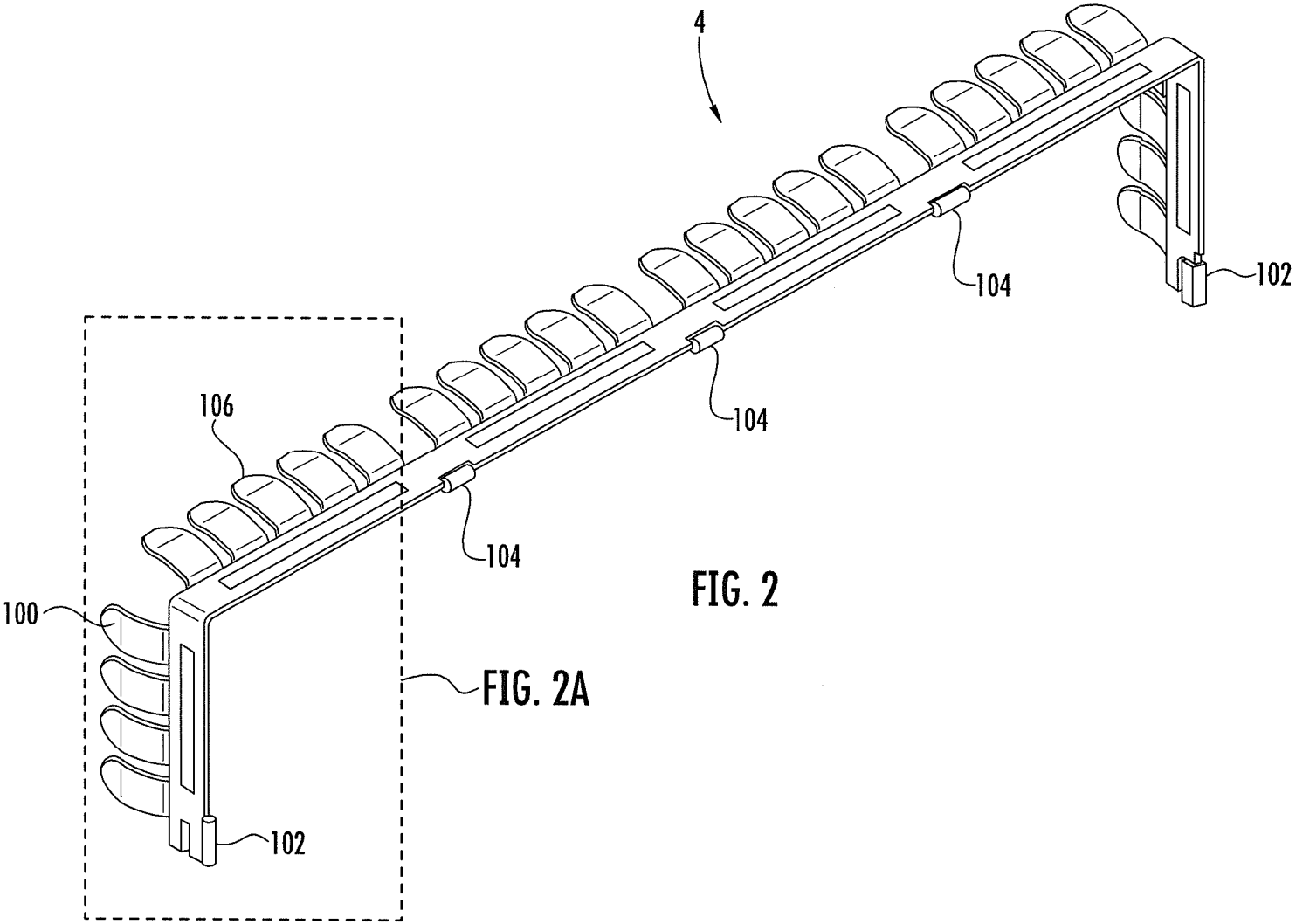
FIG. 2 is a perspective view of one embodiment of the EMI shield member of the invention; i.e., that of the electrical connector cage assembly of FIG. 1.
FIG. 2A is a detailed perspective view of the EMI shield member of FIG. 2.
Figure 2A:
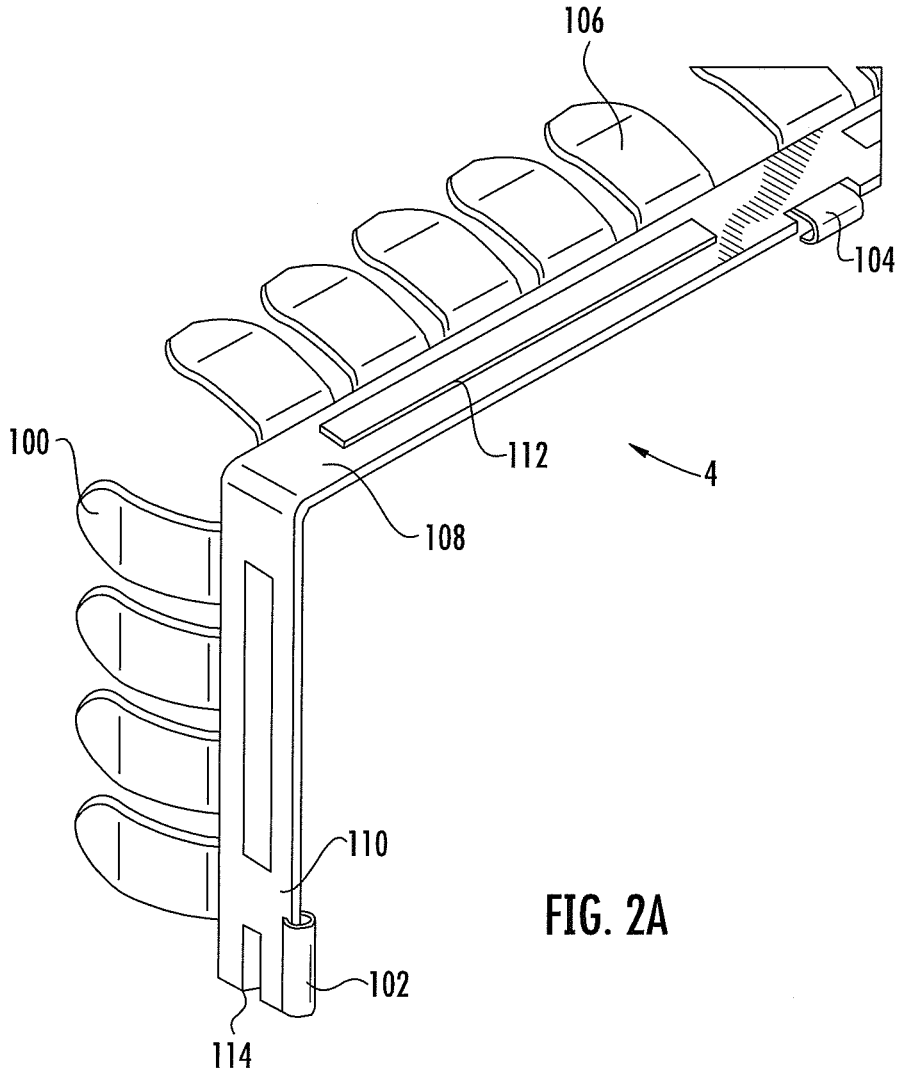

Referring now to FIG. 2, one embodiment of the EMI shield member 4 is shown and described in detail. The illustrated EMI shield member comprises a plurality of attachment features 102, 104 discussed more fully herein below as well as a plurality of EMI tabs 100, 106. It should also be noted that in an exemplary embodiment, the EMI shield member comprises a set of two components, the set comprising a top and bottom pair. The use of two EMI shield members in the connector cage assembly 2 of FIG. 1 minimizes the amount of wasted material utilized during the EMI shield member manufacturing process, thereby minimizing the material costs associated with the EMI shield members. This advantage is a result of the fact that the EMI shield member can be manufactured from a strip of base material that is approximately the width of the entire shield member (as opposed to the substantially larger width necessary if the shield member were manufactured into a single piece for the connector shown in FIG. 1).

FIG. 2A illustrates a detailed view of the EMI shield member 4 shown in FIG. 2. As can be also seen in FIG. 2A, the EMI shield member comprises a plurality of strengthening ribs 112 which add rigidity to the shield member, and which aid in the installation of the shield member onto the top and bottom shield members. Also of note in this view are the differing snap features that are implemented in another embodiment of the invention. Specifically, the EMI shield member comprises vertical snap features 102 as well as horizontal snap features 104, with the names "horizontal" and "vertical" merely being utilized to differentiate between the two different structures as opposed to being indicative of any preferred or required absolute orientation of the snap features 102, 104. In fact, it is contemplated that in some embodiments it may be desirable to choose one snap design over another, or alternatively, utilize them interchangeably at different locations throughout the EMI shield member 4.

Figure 2B:
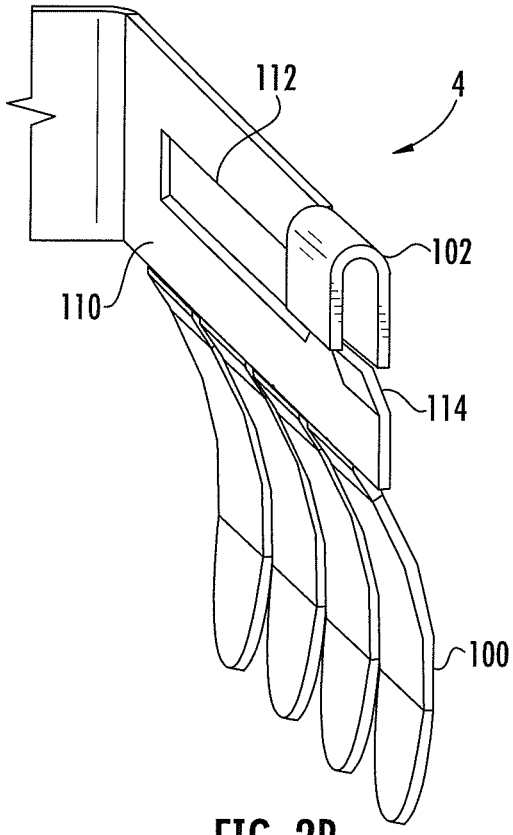
FIG. 2B is a detailed perspective view of the end tab connection of the EMI shield member of FIG. 2.
Figure 3:
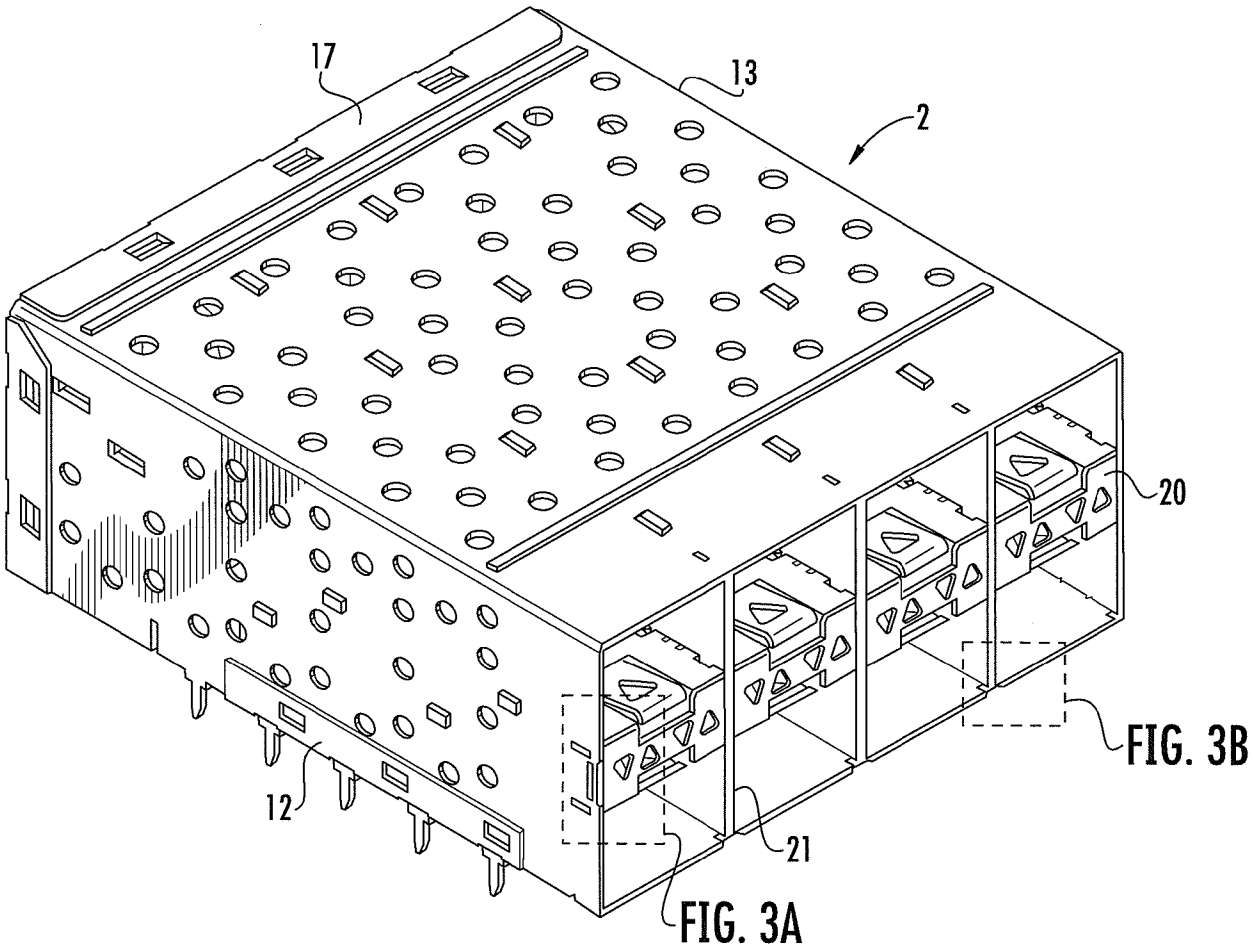
FIG. 3 is a perspective view of the electrical connector cage assembly of FIG. 1 with the EMI shield member of FIG. 2 removed.
Figure 3A:
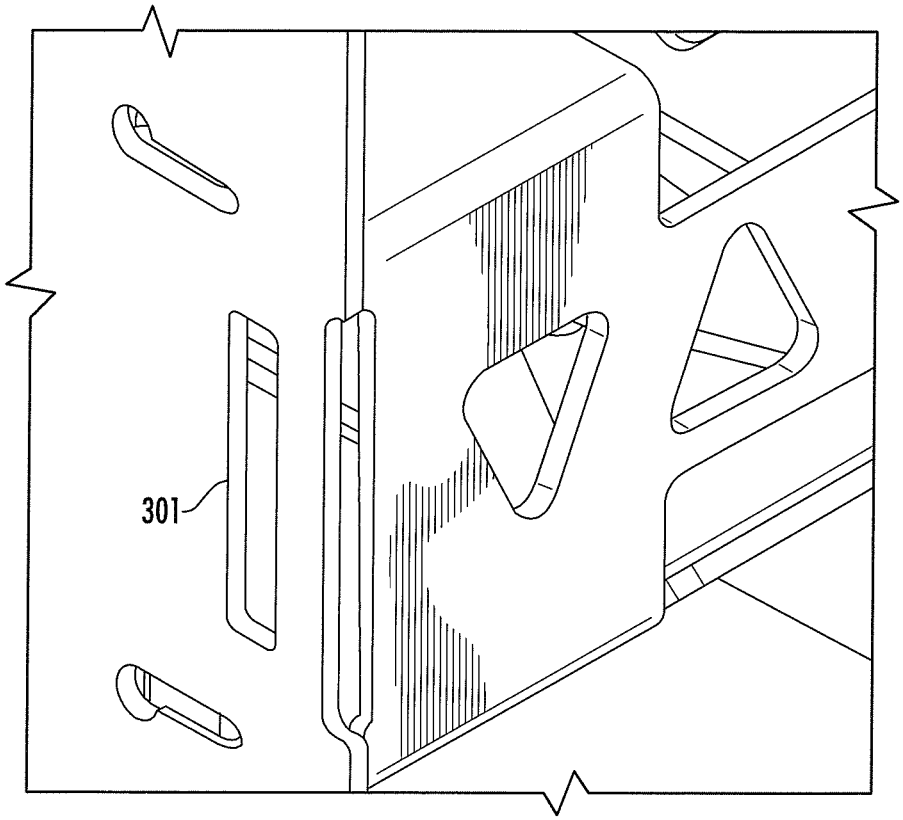
FIG. 3A is a detailed perspective view of the top cage member connection for the end tab connection shown in FIG. 2B.
Figure 3B:
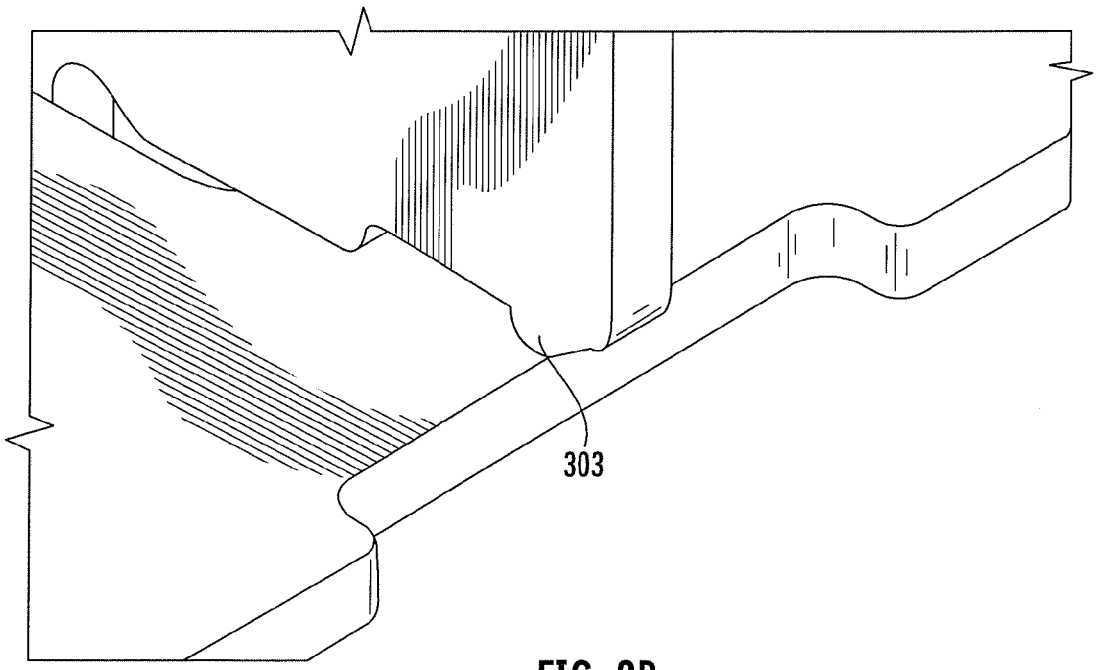
FIG. 3B is a detailed perspective view of the bottom and divider cage member connection for the middle tab connection shown in FIG. 2C.

FIG. 2B illustrates a detailed view illustrating one embodiment of the "vertical" snap feature 102 of the invention. As can be seen, the illustrated embodiment of this vertical snap feature 102 comprise a generally C-shaped element which is adapted to fit around the front edge of the top cage member 13. In addition, the vertical snap feature 102 comprises a louvered feature 114 which is adapted to be received within a respective slot 301 (FIG. 3A) located on the top cage member 13. Note that FIG. 3 illustrates the relative location of the features described in FIG. 3A (as well as FIG. 3B).

Such a design of FIG. 2B possesses several advantages over prior art techniques of implementing EMI shield members. First, the snap feature of the illustrated embodiment obviates the need for secondary processing techniques such as eutectic solder operations, spot welding and the like, although these methods can be utilized as well if desired. However, by avoiding these secondary processing techniques, manufacturing costs of the resultant cage member our minimized because the number of manufacturing processing steps are reduced.

Second, the snap design of the illustrated embodiment is relatively simple and can be produced with simplified tooling (resulting in cheaper tooling costs), as well as reducing the material consumed during the manufacturing process.

Third, the snap design can be pushed onto the top shield member without requiring any sort of manipulation of the EMI shield member or top shield member by the user. In other words, the EMI shield member can be attached to the top shield member via a single user action (i.e. by inserting the EMI shield member onto the front face of the connector). Because of this, installation of the EMI shield member is simplified, and can readily be automated if desired.

Fourth, the snap design is readily reversible such that the remaining cage member assembly is compatible with prior art connector designs such as an SFP (as opposed to SFP+) connector design.

Figure 2C:
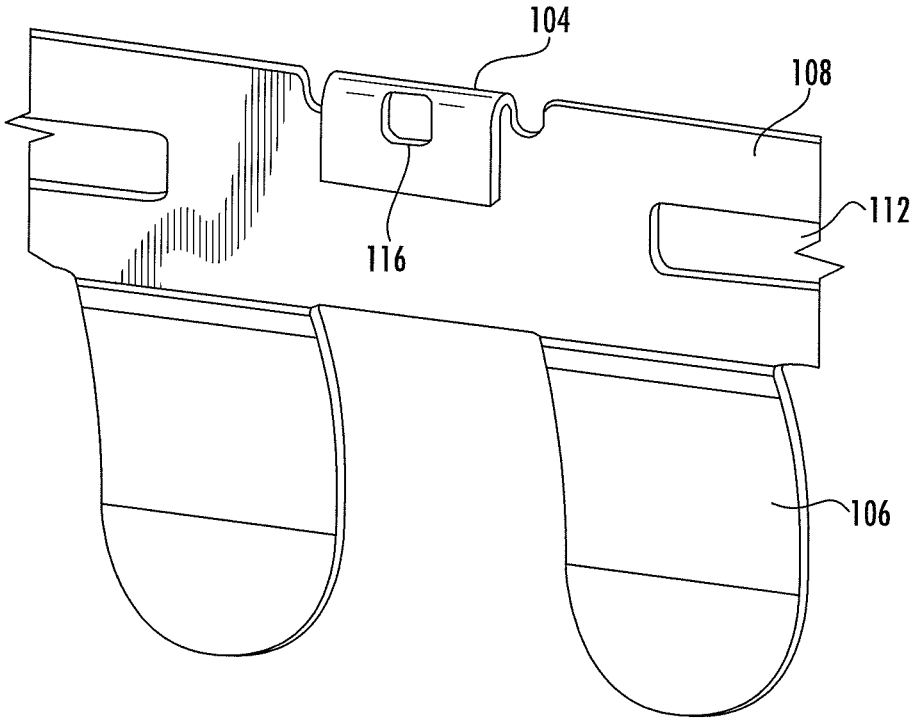
FIG. 2C is a detailed perspective view of a middle tab connection of the EMI shield member of FIG. 2.

FIG. 2C is a detailed view of one embodiment of the "horizontal" snap feature 104. As can be seen, the horizontal snap feature again comprises a generally C-shape structure which is adapted to fit around the front edge of the top cage member 13. In addition, the horizontal snap feature 104 comprises a cavity feature 116 which is adapted to receive a respective post 303 (FIG. 3B) located on the divider cage member 21. Similar to that illustrated with respect to the vertical snap feature 102, such a design possesses several advantages over prior art techniques of implementing separate EMI shield members. First, the snap design of the illustrated embodiment obviates the need for secondary processing techniques such as eutectic solder operations, spot welding and the like, although these methods can be utilized as well. Second, the snap design of the illustrated embodiment is relatively simple and can be produced with simplified tooling (resulting in cheaper tooling costs) as well as reducing the material consumed during the manufacturing process. Third, the snap design can be pushed onto the top shield member without requiring any sort of manipulation of the EMI shield member or top shield member by the user. Because of this, installation of the EMI shield member is simplified and can readily be automated if desired.

Methods of Manufacture

Exemplary embodiments of the method of manufacturing the connector assembly of the invention are now discussed in detail. It will be appreciated that while these embodiments are described primarily in the context of the connector assembly 2 described above, these methods are in no way so limited, and in fact may be applied to other connector assembly configurations, such application being readily within the skill of the ordinary artisan given the present disclosure.

Figure 4:
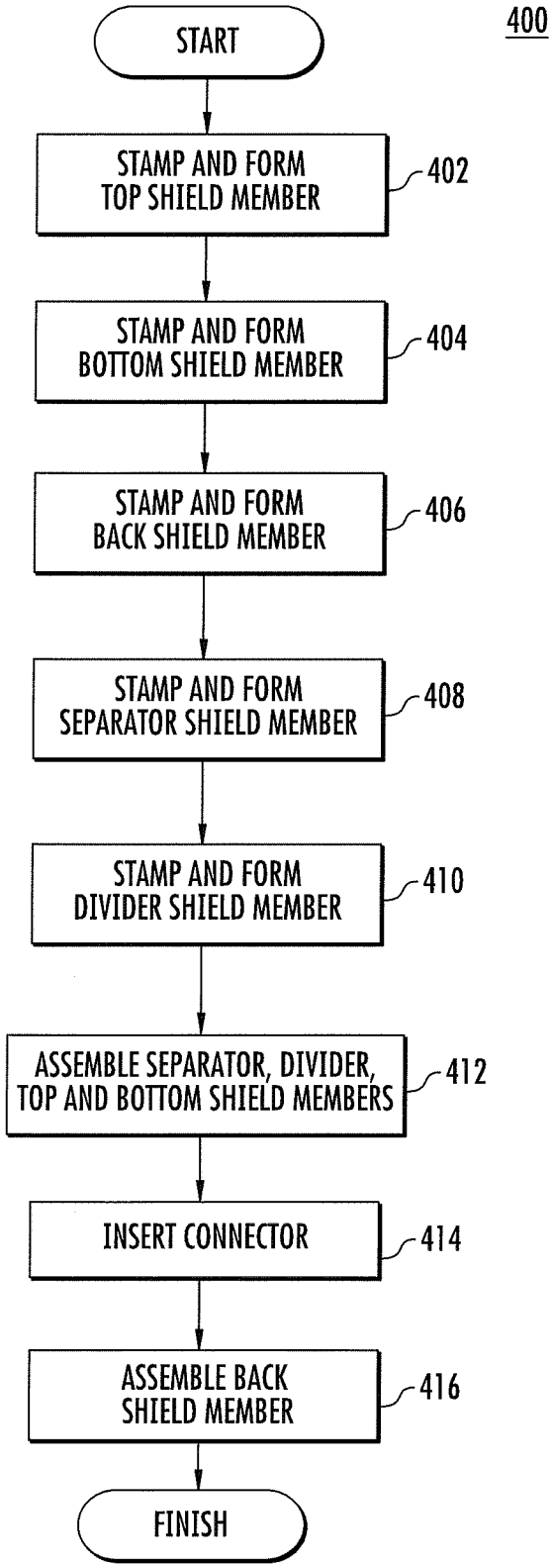
FIG. 4 is a process flow diagram illustrating a first exemplary method for manufacturing the electrical connector assembly of FIG. 3.

Referring now to FIG. 4, a first exemplary method 400 for manufacturing the connector assembly 2 of FIG. 3 is shown and described in detail. At step 402, the top shield member 13 is stamped and formed from a flat stock metallic base material. In one embodiment, the flat stock metallic base material is post-plated subsequent to the stamping and forming process. Typically this post-plating will comprise tin-lead plating over a nickel under plate. However, other plating processes may be used (such as a lead-free alternative) as would be readily understood by one of ordinary skill.

At step 404, the bottom shield member is stamped and formed. At steps 406, 408 and 410, the back shield member, separator shield member, and divider shield member are stamped and formed, respectively.

At step 412, the separator, divider, top and bottom shield members are assembled. In one exemplary embodiment, the aforementioned shield members are assembled using processing techniques which do not require any secondary processing. Alternatively, secondary processing techniques such as soldering, epoxy (conductive or otherwise) and the like could be used if desired.

At step 414, the connector housing is inserted into the assembled cage assembly, and the back shield member is assembled onto the back of the assembly at step 416, thereby completing the assembly.

Figure 5:
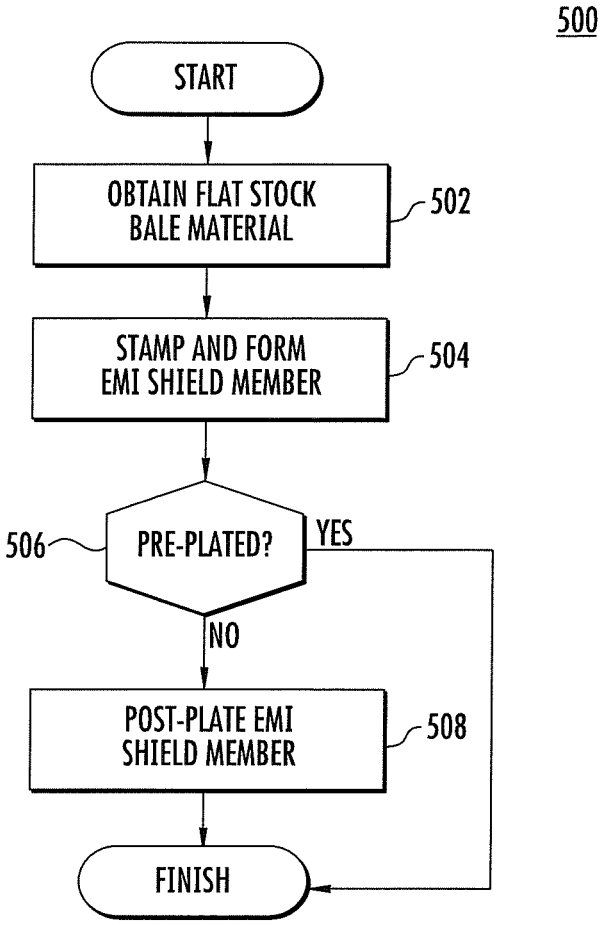
FIG. 5 is a process flow diagram illustrating a first exemplary method for manufacturing the EMI shield member of FIG. 2.

Referring now to FIG. 5, an exemplary embodiment of the method for manufacturing the EMI shield member of FIG. 2 is shown and described in detail. At step 502 of the process 500, flat stock base material for the EMI shield member is obtained. In one variant, this flat stock base material is pre-processed so as to facilitate the stamp, form and optional plating processes discussed subsequently herein.

At step 504, the EMI shield member of FIG. 2 is stamped and formed, such as e.g., using well known progressive stamping equipment.

At step 506, a determination is made whether to post-plate the EMI shield member based on the material choice made at step 502. If the base material chosen at step 502 is not otherwise protected and/or pre-plated, then the EMI shield member is post-plated at step 508.

Figure 6:
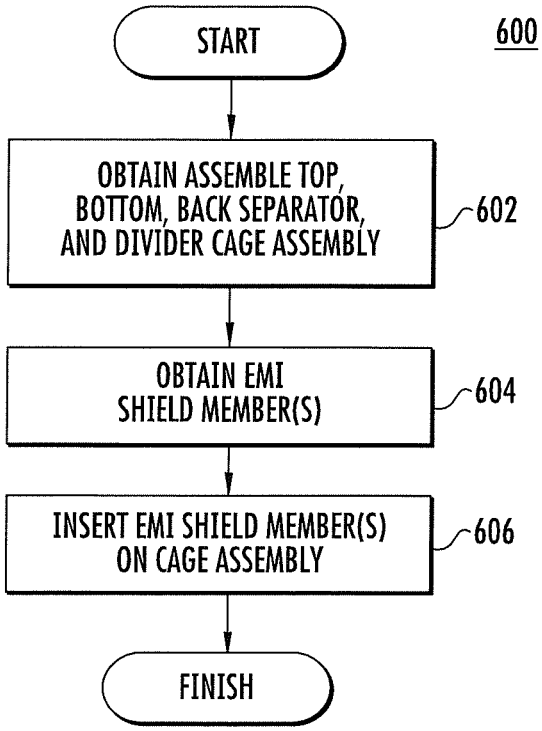
FIG. 6 is a process flow diagram illustrating a first exemplary method for assembling the EMI shield member of FIG. 2 with the electrical connector cage assembly shown in FIG. 3.

Referring now to FIG. 6, a first exemplary embodiment of the method for assembling the EMI shield member of FIG. 2 with the electrical connector cage assembly shown in FIG. 3 is shown and described in detail. At step 602 of the process 500, the assembled cage assembly is obtained from, for example, the method described in FIG. 4.

At step 604, the EMI shield member(s) from, for example, the method described in FIG. 5 is obtained.

At step 606, the EMI shield member(s) are assembled onto the cage assembly. In one embodiment, this is accomplished without the need for manipulating either the cage assembly or EMI shield member(s); i.e., they can be assembled together in a substantially single action or motion. As previously described, the snap design enables the EMI shield member to be pushed onto the top shield member without requiring any sort of manipulation of the EMI shield member or top shield member by the user. In other words, the EMI shield member can be attached to the top shield member via a single user action (i.e, by inserting the EMI shield member onto the front face of the connector). Because of this, installation of the EMI shield member is simplified, and can readily be automated if desired. This substantially single action or motion can be accomplished by either an operator using manual techniques (e.g. use of the operator's hands), or alternatively these can be assembled using a substantially automated process.

Methods of Use

Figure 7:
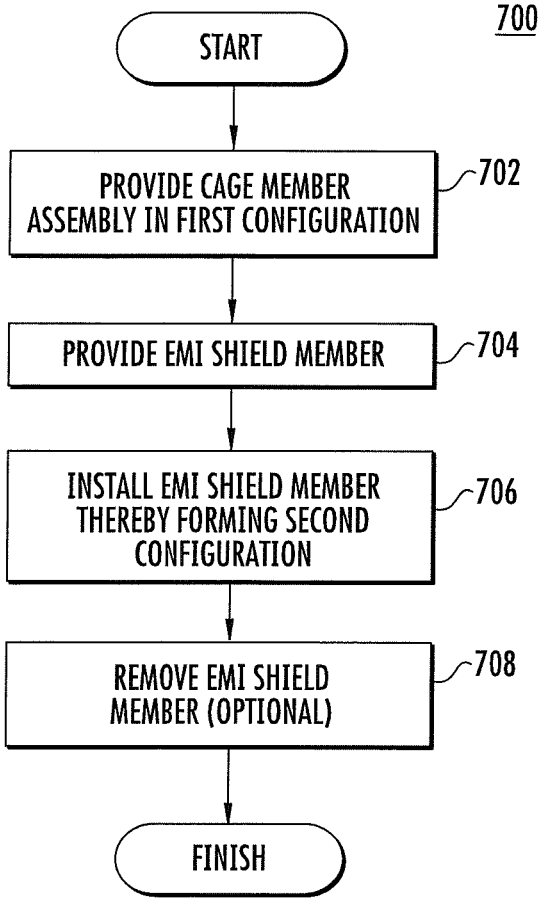
FIG. 7 is a process flow diagram illustrating a first exemplary method of using a cage member assembly in accordance with the principles of the present invention.

Referring now to FIG. 7, a method of using a cage member assembly 700 in at least two configurations is shown and described in detail. At step 702, the cage member assembly in a first configuration is provided. The cage member, in one exemplary embodiment, comprises a multi-port cage assembly comprising top, bottom, back, separator and divider cage members which make up the multi-port cage assembly.

At step 704, an EMI shield member is provided. In one exemplary embodiment, the EMI shield member comprises a plurality of features which interact with respective features on e.g. the multi-port cage assembly so that the multi-port cage assembly and EMI shield member can be assembled without the need for secondary processing techniques.

At step 706, the EMI shield member is installed on the cage member assembly thereby forming a second configuration for the cage member assembly. In one exemplary embodiment, the second configuration comprises an "SFP+" configuration while the first configuration comprises an "SFP" configuration.

At step 708, the installation of the EMI shield member on the cage member assembly is reversed thereby returning the cage member assembly back to the first configuration.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An electrical connector assembly, comprising:

an insulative housing; and a shield assembly at least partly enclosing the insulative housing and comprising a body shield member having one or more port openings, and a noise shield member disposed at least partly around the body shield member adjacent the one or more port openings;

wherein the noise shield member comprises one or more snap features that cooperate with a respective feature on the body shield member, the cooperation obviating a need for one or more secondary processing techniques when disposing the noise shield member around the body shield member; and wherein at least one of the one or more snap features comprises a generally C-shaped element, the C-shaped element configured to fit substantially around at least a portion of an edge of the body shield member such that the one or more snap features contact both an internal and external face of the noise shield member.

2. The electrical connector of claim 1, wherein the snap feature further comprises a louvered feature disposed proximate the C-shaped element.

3. The electrical connector of claim 2, wherein the shield assembly further comprises a slot, the slot sized to accommodate the louvered feature.

4. The electrical connector of claim 3, wherein the noise shield member further comprises a plurality of electromagnetic interference (EMI) tabs.

5. The electrical connector of claim 1, wherein the generally C-shaped element has a cavity feature disposed therein.

6. The electrical connector of claim 5, wherein the generally C-shaped element comprises an inner portion, an outer portion, and a transitional portion disposed there between, and the cavity feature is disposed at least on the outer portion of the generally C-shaped element.

7. The electrical connector of claim 6, wherein the shield assembly further comprises a post feature, the post feature sized to fit at least partially within the cavity feature of the generally C-shaped element.

8. The electrical connector of claim 7, wherein the post feature is disposed on a divider cage member of the shield assembly.

9. The electrical connector of claim 6, wherein the outer portion is disposed within the port opening when the noise shield member is disposed on the shield assembly.

10. The electrical connector of claim 1, wherein the one or more secondary processing techniques comprise at least one of: (i) eutectic solder processing, and/or (ii) spot welding.

11. A noise shield member for use on an electrical connector assembly, the noise shield member comprising an attachment feature, the attachment feature comprising:

a substantially arcuate portion, the substantially arcuate portion extending outward from the noise shield member and configured to house a front edge of a port opening of the electrical connector assembly; and a protruding portion that extends inward toward the interior of the port opening when the noise shield member and the electrical connector assembly are assembled.

12. The noise shield member of claim 11, wherein the arcuate portion comprises a substantially C-shaped element.

13. The noise shield member of claim 12, wherein the protruding portion comprises a louvered feature disposed proximate the substantially C-shaped element.

14. The noise shield member of claim 11, wherein the noise shield member comprises a top noise shield member and a distinct bottom noise shield member; and wherein use of the distinct bottom noise shield member is configured to minimize an amount of wasted material during the noise shield member manufacturing process.

15. An electrical connector assembly, comprising:

an insulative housing; and a shield assembly at least partly enclosing the insulative housing and defining a plurality of port openings, the shield assembly comprising:

an external shield member;

a noise shield member disposed about the external shield member and adjacent the plurality of port openings; and a divider shield member that at least partly separates at least two of the plurality of port openings;

wherein the noise shield member comprises an attachment feature that cooperates with a respective feature at the port openings defined by the shield assembly to secure the noise shield member to the external shield member; and wherein the attachment feature comprises a shield receiving portion, the shield receiving portion configured to fit substantially round a front edge that defines at least one of the port openings of the shield assembly.

16. The electrical connector of claim 15, wherein the attachment feature further comprises a protruding feature in addition to the shield receiving portion.

17. The electrical connector of claim 16, wherein the external shield member further comprises a slot, the slot sized to accommodate the protruding feature.

18. The electrical connector of claim 17, wherein the shield receiving portion comprises a cavity feature disposed therein.

19. The electrical connector of claim 18, wherein the divider shield member comprises a post feature, the post feature sized to fit at least partially within the cavity feature of the shield receiving portion.

* * * * *